US009616268B2

(12) United States Patent
Miyoshi

(10) Patent No.: US 9,616,268 B2
(45) Date of Patent: Apr. 11, 2017

(54) EXERCISE CUSHION

(71) Applicant: Tokyu Sports Oasis Inc., Tokyo (JP)

(72) Inventor: Yasumasa Miyoshi, Tokyo (JP)

(73) Assignee: Tokyu Sports Oasis Inc., Tokyo (JP)

( * ) Notice: Subject to any disclaimer, the term of this patent is extended or adjusted under 35 U.S.C. 154(b) by 0 days.

(21) Appl. No.: 14/867,435

(22) Filed: Sep. 28, 2015

(65) Prior Publication Data

US 2016/0107018 A1 Apr. 21, 2016

Related U.S. Application Data

(63) Continuation of application No. PCT/JP2014/058246, filed on Mar. 25, 2014.

(51) Int. Cl.
*A63B 21/045* (2006.01)
*A63B 21/02* (2006.01)
(Continued)

(52) U.S. Cl.
CPC ..... *A63B 21/045* (2013.01); *A47C 16/00* (2013.01); *A63B 21/0004* (2013.01); *A63B 21/00043* (2013.01); *A63B 21/00061* (2013.01); *A63B 21/00185* (2013.01); *A63B 21/02* (2013.01); *A63B 21/0428* (2013.01); *A63B 21/05* (2013.01); *A63B 21/0555* (2013.01);
(Continued)

(58) Field of Classification Search
CPC ..... A63B 21/0552; A63B 2210/50; A63B 21/4035; A63B 21/0557; A63B 2208/0233; A63B 21/4029; A63B 21/068; A63B 2225/09; A63B 21/055; A63B 21/4047; A63B 21/4043; A63B 21/4037; A63B 22/16; A63B 21/02; A63B 21/4031; A63B 22/203; A63B 23/0233; A63B 21/0023; A63B 2208/0252; A63B 2225/093; A63B 2023/006; A63B 21/045
USPC ..... 482/121–123, 127–130, 142; 267/133
See application file for complete search history.

(56) References Cited

U.S. PATENT DOCUMENTS 4,830,345 A 5/1989 Mar ..... 267/133
5,499,417 A 3/1996 Wang ..... 5/652
(Continued)

FOREIGN PATENT DOCUMENTS

DE 29509694 U1 3/1996
JP 3114978 U 11/2005
(Continued)

*Primary Examiner* — Andrew S Lo
(74) *Attorney, Agent, or Firm* — Christopher P. Maiorana, PC

(57) ABSTRACT

Provided herein is an exercise cushion that may be used as a cushion and is configured to be used for performing stretches of the backbone, the muscles of the legs and arms or the like. The exercise cushion may comprise: a core main body, an elastic member, a pair of cushion bags, an inner cushion and a cushion cover. The core main body may comprise a pair of core boards each having an arc shape and are connected to each other in a bendable manner. The elastic member may resist against a force generated when the core boards are bent. The pair of cushion bags may house the core boards. The inner cushion may be configured to be inserted into the cushion bags with the core boards. The cushion cover may cover the cushion bags after the core boards and the inner cushion are inserted into the cushion bags.

9 Claims, 4 Drawing Sheets

(51) Int. Cl.

| | |
|---|---|
| ***A63B 21/055*** | (2006.01) |
| ***A63B 22/16*** | (2006.01) |
| ***A63B 23/02*** | (2006.01) |
| ***A63B 23/035*** | (2006.01) |
| ***A63B 23/12*** | (2006.01) |
| ***A63B 21/04*** | (2006.01) |
| ***A63B 21/00*** | (2006.01) |
| ***A47C 16/00*** | (2006.01) |
| ***A63B 21/05*** | (2006.01) |
| ***A63B 23/04*** | (2006.01) |

(52) U.S. Cl.

CPC ..... *A63B 21/0557* (2013.01); *A63B 21/4033* (2015.10); *A63B 21/4035* (2015.10); *A63B 21/4047* (2015.10); *A63B 22/16* (2013.01); *A63B 23/0238* (2013.01); *A63B 23/0355* (2013.01); *A63B 23/03516* (2013.01); *A63B 23/0482* (2013.01); *A63B 23/1236* (2013.01); *A63B 23/1254* (2013.01); *A63B 2208/0204* (2013.01); *A63B 2208/0233* (2013.01)

(56) References Cited

U.S. PATENT DOCUMENTS

| | | | | |
|---|---|---|---|---|
| 6,413,194 | B1 * | 7/2002 | Gant | A47C 7/021 482/112 |
| 6,461,283 | B1 * | 10/2002 | Maron | A63B 21/023 482/123 |
| 2006/0040803 | A1 | 2/2006 | Perez, Jr. | 482/112 |
| 2007/0238590 | A1 | 10/2007 | Jin | 482/121 |
| 2014/0378283 | A1 * | 12/2014 | Qiu | A63B 26/00 482/142 |

FOREIGN PATENT DOCUMENTS

| | | | | |
|---|---|---|---|---|
| JP | 2007275601 | A | 10/2007 | A63B 21/02 |
| JP | 3139983 | U | 3/2008 | |
| JP | 2013022447 | A | 2/2013 | A63B 23/00 |
| JP | 3183997 | | 6/2013 | A63B 21/02 |
| JP | 3179684 | U | 11/2015 | |
| WO | WO 2006/017657 | | 2/2006 | |

* cited by examiner

EXERCISE CUSHION

This application relates to International Application PCT/JP2014/058246, with an International Filing Date of Mar. 25, 2014, which claims the benefit of Japanese Application No. 2013-001757, filed Mar. 29, 2013, each of which is incorporated by reference in its entirety.

FIELD OF THE INVENTION

The present invention relates to an exercise cushion that can be used for performing an exercise of a femoral region such as a hip joint adduction movement, and an exercise of an arm or a breast region or the like, while serving as a cushion such as a seat, a back cushion or the like.

BACKGROUND OF THE INVENTION

Conventionally, various kinds of expanders for toning up (strengthening) an arm muscle and training machines or exercise assistive tools for toning up (strengthening) a leg muscle or the like have been developed and have been available on the market. For example, Patent Literature 1 proposes exercise equipment in which two arms are coupled (joined) in a V shaped manner and the coupled arms are clamped (constringed) with both hands so as to oppose expansion of the exercise equipment in order to tone up a muscle for a clamping or bending force of an arm. On the other hand, Patent Literature 2 proposes another exercise equipment in which two elastic members having a wedge shape are pinched (put) between thighs so as to tone up associated muscles.

Conventional training machines are only useful if they are operated for performing an exercise. Conventional training machines, when not used, are likely to be subject to storage, occupy space and serve no other purpose.

Therefore, an object of the present invention is to solve the above mentioned problem and to provide an exercise cushion that is capable of being used as a cushion and moreover being used for performing a stretch or strengthening of the muscles of the legs or the arms or a backbone by use of the cushion.

SUMMARY OF THE INVENTION

According to the present invention, an exercise cushion is provided that is capable of being used as an ordinary cushion while serving as an exercise machine. The present invention may be implemented by covering the present invention with a cushion material, configuring a pair of core boards in a bendable manner through an elastic member and further covering the core boards and the cushion material. Accordingly, the present invention is capable of achieving a significant and advantageous effect that an exercise can be performed and that the exercise cushion is kept placed on a sofa at all times.

The present invention has been made in order to achieve the above described object, and according to one embodiment of the present invention, an exercise cushion is provided that may comprise: a core main body in which a pair of core boards formed in an arc shape are engaged with each other in a bendable manner; an elastic member may be provided so as to resist against a force generated when the core boards are bent; a pair of cushion bags for housing the core boards, respectively; an inner cushion being inserted into the cushion bag with the core board; and a cushion cover for covering the cushion bags after the core boards and the inner cushion are inserted into the cushion bags.

Preferably, the core boards may comprise: a center core portion having a halved ellipse shape and being formed in a parallel cross (well curb) shape with a plurality of ribs; and a base plate for covering a surface of the center core portion and having a flap extending outward obliquely from both sides of a circumferential portion of the center core portion.

Preferably, the center core portion may include a joint face portion provided with a protruding portion (protrusion or projection) engaging the other joint face portion of the other center core portion, and an engaging groove connecting the protruding portion, and the protruding portion and the engaging groove serve as a fulcrum (fulcrum point) when the core boards are bent.

Preferably, a pair of elastic members are arranged in parallel between elastic member support (supporting) pieces provided in the center core portion of the core boards. Preferably, the core boards are coupled by (with) an opening preventive equipment composed of a woven belt so as to prevent the core boards from opening excessively.

Preferably, the opening preventive equipment comprises: a woven belt formed in an endless shape; a belt insertion hole formed in the core board and for allowing loop portions of the woven belt to be exposed to a surface of the core board; and a fixing rod being inserted into the belt insertion hole and then inserted into the loop portions at both ends of the woven belt attached to a surface of the core board so as to couple the woven belt to the core board.

Yet preferably, the elastic member is configured such that cylindrical elastic members are integrally coupled by a coupling piece, and the elastic member is arranged between the elastic member supportive pieces arranged in the center core portion of the core board.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

Hereinafter, preferred embodiments of the present invention will be described in detail with reference to the accompanying drawings.

Figure 1:
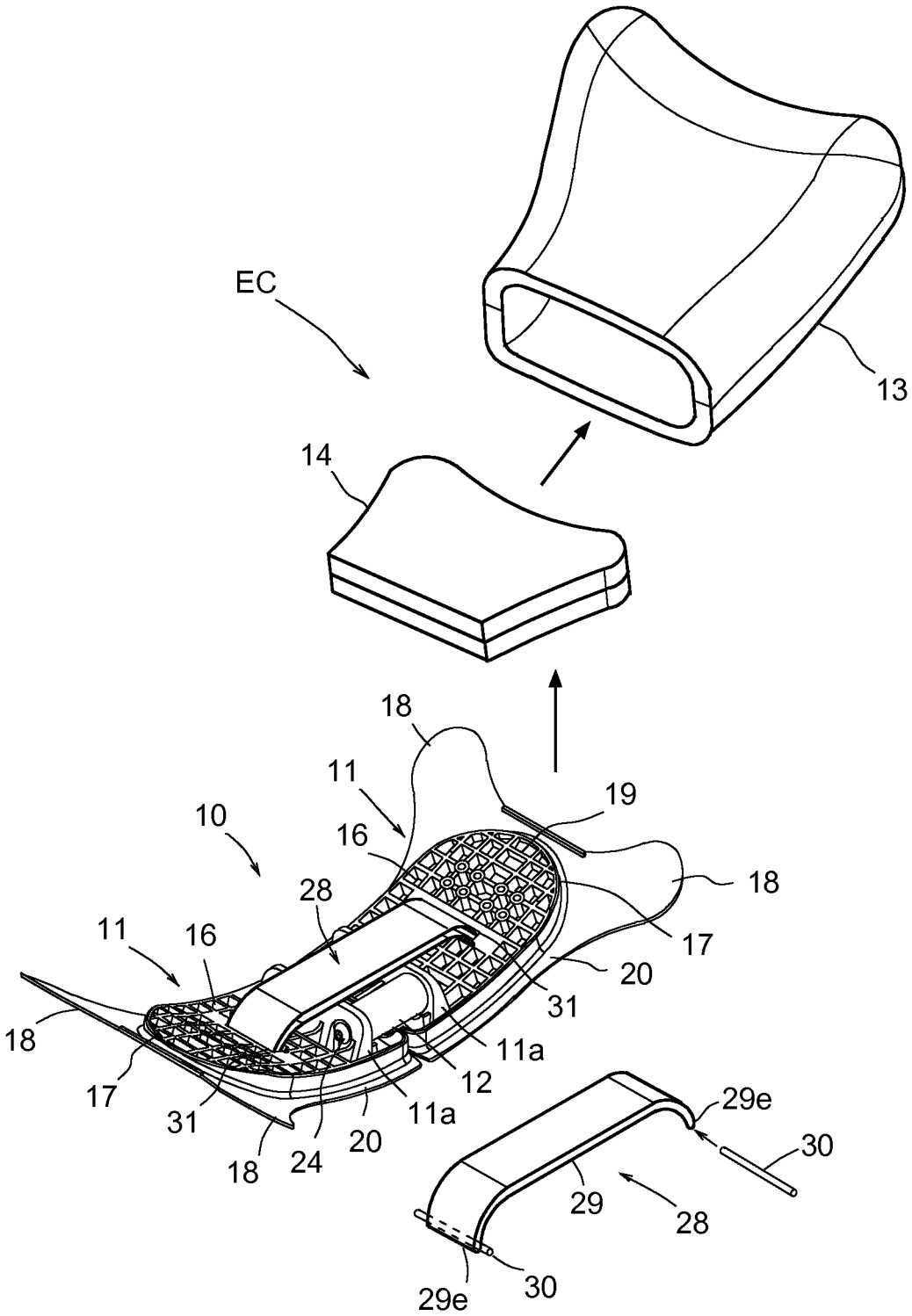
FIG. 1 are views illustrating an exploded perspective view and an assembly of an exercise cushion according to the present invention.
Figure 2:
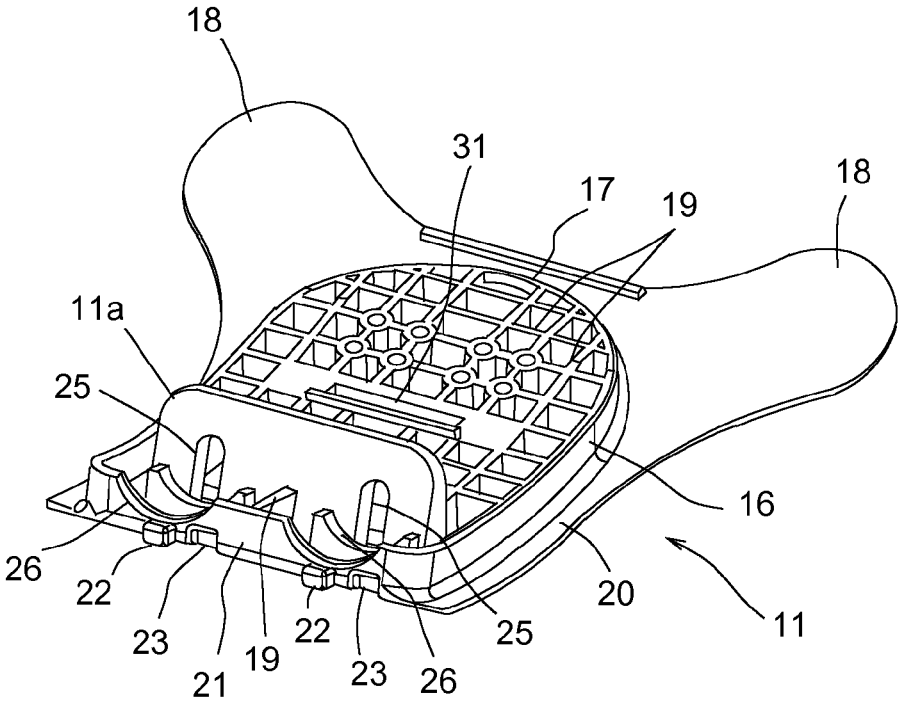
FIG. 2 is a detailed perspective view of a core board according to the present invention.
Figure 3:
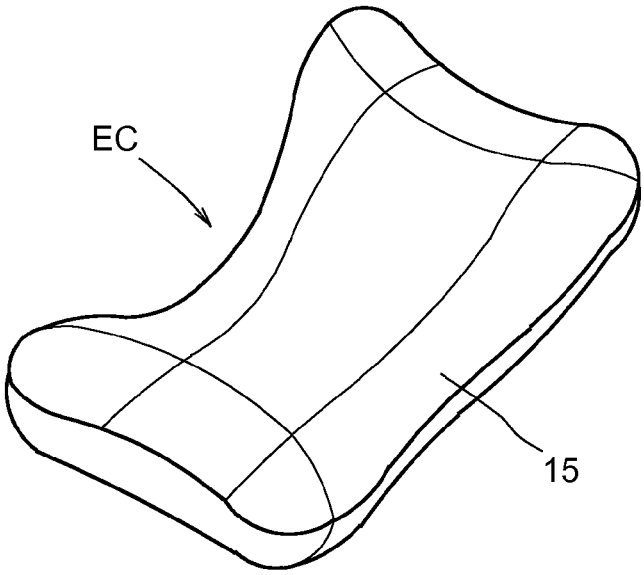
FIG. 3 is a perspective view of an exercise cushion according to the present invention.

As shown in FIGS. 1 and 2, an exercise cushion (EC) according to the present invention comprises a core main body 10, cylindrical shaped elastic members 12, 12, a pair of cushion bags 13, 13, inner cushions 14, 14, and a cushion cover 15 (FIG. 3). The core main body 10 comprises a pair of core boards 11, 11 formed in an arc shape which are connected to each other in a bendable (or flexible) manner. The cylindrical shaped elastic members 12, 12 are mounted in parallel between elastic member supportive pieces 11*a*, 11*a* of the core boards 11, 11. The cushion bags 13, 13 house the core boards 11, 11. The inner cushions 14, 14 are composed of urethane (polyurethane) foam and inserted into the cushion bags 13, 13 into which the core boards 11, 11 are inserted so as to improve the cushioning property. The cushion cover 15 (FIG. 3) covers the cushion bags 13, 13 after the core boards 11, 11 and the inner cushions 14, 14 are inserted into the cushion bags 13, 13.

Each core board 11 is formed with a rigid plastic such as polypropylene (PP). Each core board 11 comprises a center core portion 16 and a base plate 20. The center core portion 16 has a halved elliptical shape (or curve) and is formed in a parallel crossing (well curb) shape with a plurality of ribs 19. The base plate 20 covers a surface of the center core portion 16 (e.g., a rear surface in FIG. 1). The base plate 20 also comprises flaps 18, 18, which are formed in the base plate 20 and extend outward obliquely from both sides of a circumferential portion 17 of the center core portion 16.

Although FIG. 2 shows only one core board 11, it should be noted that the other core board 11 also has a similar shape and configuration. The core boards 11, 11 are configured to face each other to constitute (form) the core main body 10. A joint face portion 21 of the center core portion 16 of the core board 11 is provided with a protruding portion (protrusion or projection) 22 configured to engage with the other joint face portion 21 of the other center core portion 16 via an engaging groove 23. Connecting the protruding portion 22 and the engaging groove 23 to each other may allow the joint face portions 21, 21 to be butted against each other. The protruding portion 22 and the engaging groove 23 serve as a fulcrum in order to bend the core boards 11, 11.

Elastic member supportive pieces 11*a*, 11*a* may be implemented on (integrated with) the center core portion 16 in a standing manner. Elongated holes 25 may be formed in the elastic member supportive pieces 11*a*, 11*a* in order to hold the cylindrical elastic members 12, 12 with fasteners 24, 24, respectively. Supportive grooves 26, 26 may be formed in the joint face portion 21 of the center core portion 16 that is inside the elastic member supportive piece 11*a*. Supportive grooves 26, 26 may be configured in an arc shape to guide the cylindrical elastic members 12, 12.

In order to apply a compressive load to the elastic members 12, 12, the core boards 11, 11 are configured such that the core boards 11, 11 are capable of bending upwards against the compressive load of the elastic members 12, 12, as shown in FIG. 1. A detachable opening preventive equipment 28 shown in FIG. 1 may be implemented for the core boards 11, 11 so as to prevent the core boards 11, 11 from excessively opening downwards.

The opening preventive equipment 28 comprises a woven belt 29, a fixing rod 30 and loop portions 29*e*, 29*e*. The woven belt 29 is formed in a closed loop shape. The fixing rod 30 is inserted into loop portions 29*e*, 29*e* at both ends of the woven belt 29. A belt insertion hole 31 is formed in the center core portion 16 of the base plate 20, and allows the loop portions 29*e* of the woven belt 29 to be mounted to a surface of the base plate 20.

In order to mount the opening preventive equipment 28, first, the loop portion 29*e* of the woven belt 29 is inserted into the belt insertion hole 31, and then the loop portion 29*e* may be attached to the surface of the base plate 20. The fixing rods 30 may be inserted into the loop portions 29*e*. Both ends of each fixing rod 30 extend across the respective belt insertion holes 31 on the surface of the base plate 20 and are then held in the belt insertion holes 31. Holding the fixing rods 30 in the belt insertion holes 31 may prevent the loop portion 29*e* of the woven belt 29 from falling off (slipping off) the belt insertion hole 31. As a result, the core boards 11, 11 are efficiently prevented from excessively opening downwards by the woven belt 29.

The inner cushion 14 may be implemented such that a urethane foam with a thickness of 20 mm to 30 mm may be formed to the shape of the base plate 20 of the core board 11. One to three or four sheets of the formed urethane foam may be overlapped (piled). The cushion bag 13 houses the core board 11 and the inner cushion 14 when the inner cushion 14 is overlapped on the core board 11. The cushion bag 13 may have both cushioning and stretching properties.

In order to assemble the exercise cushion EC, as shown in FIGS. 1 and 2 (e.g., with the joint face portions 21, 21 of the core boards 11, 11 being butted against each other), the elastic members 12, 12 may be attached by the fastener 24 between the elastic member supportive pieces 11*a*, 11*a*. The opening preventive equipment 28 may be mounted onto both of the core boards 11, as described above. The inner cushion 14 may then be overlapped on the core boards 11, 11. The overlapped inner cushion 14 and the core boards 11, 11 may then be inserted into the cushion bag 13. After the cushion bag 13 is mounted (prepared) such that the cushion bag 13 covers the core boards 11, 11 and the inner cushion 14, the cushion cover 15 covers the whole as shown in FIG. 3.

The flaps 18, 18 may be implemented on the core board 11 on an opposite side of the joint face portion 21. The flaps 18, 18 serve as resistive elements so as to prevent the cushion bag 13 from falling off (slipping off) after covering the inner cushion 14 and the core boards 11, 11. As shown in FIGS. 3, 4A, 4B and 4C, in some embodiments, the exercise cushion EC may have an approximately rectangular shape from a planar view. Four corners of the exercise cushion EC may protrude with the flap 18. The exercise cushion EC may be formed in an arc shape when viewed from a front view. The cushion cover 15 may conceal the coupled (joint) portion of the cushion bags 13, 13. The cushion cover 15 may be formed with a stretching fabric and/or a raised fabric or the like so as to achieve the function of a cushion (e.g., a pillow, a sofa cushion, etc.). The exercise cushion EC may be left indoors.

In one example, to perform an exercise by use of the exercise cushion EC, when strengthening (toning up) the muscles, the exercise cushion EC may be held between the thighs of a user when the legs are spread apart. The legs may then be closed to bend the core boards 11, 11 as shown in FIG. 4B. By closing the exercise cushion EC with the legs, an exercise of the muscles of the inner thighs may be performed. In another example, when the exercise cushion EC is held in the hands of a user to bend the exercise cushion EC, the arm muscles may be toned up (strengthened).

Figure 4A:
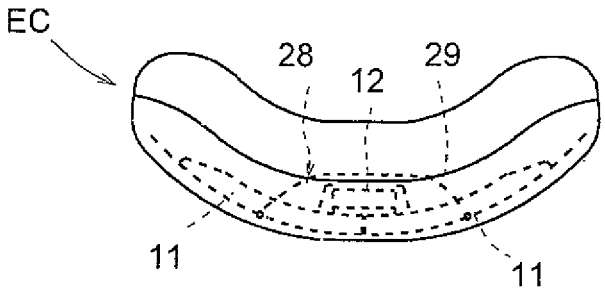
FIG. 4A, FIG. 4B and FIG. 4C are views illustrating various use states of the exercise cushion according to the present invention.
Figure 4B:
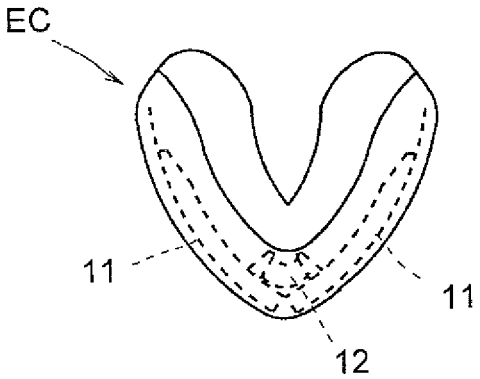

A user may sit on the center of the exercise cushion EC when the exercise cushion EC is in the state shown in FIG. 4A. The user may bend his/her legs beneath the EC (e.g., sit straight). The user may lay his/her head on the exercise cushion EC like a pillow, sit his/her lower back (waist) and/or buttocks against the exercise cushion EC, etc. In either of these examples, the user may swing their body from left to right to perform an exercise that improves physical balance and/or tones up (strengthens) the abdominal muscles or the like.

Figure 4C:
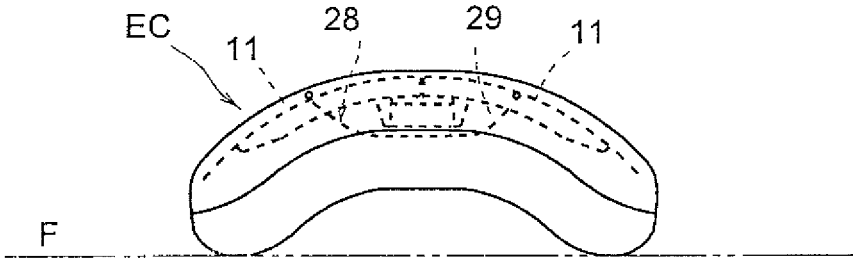

Also, as shown in FIG. 4C, with a convex portion of the exercise cushion EC facing upwards, when the user lies down over the convex portion, the backbones may be stretched. Furthermore, the exercise cushion EC may be leaned against a backrest of a chair (or other type of seat). When the user sits on the chair and leans against the exercise cushion EC, the backbones may also be stretched.

Since the core boards 11, 11 are coupled to each other with the opening preventive equipment 28 composed of the woven belt 29, even if the body weight of the user is applied to the exercise cushion EC, the applied load is accommodated (absorbed or counteracted) by the opening preventive equipment 28. As a result, an excessive load applied to the joint face portion 21 of the core boards 11, 11 may be avoided.

The exercise cushion. EC, according to the present invention, may have the same function as a cushion that is used for a chair and/or a sofa. Thus, with the exercise cushion EC being placed on the chair and/or the sofa, the exercise cushion EC may be used as a cushion. As a result, the above mentioned various exercises may be readily performed whenever the user has an inclination to exercise (e.g., without a time-consuming set up and/or removal of exercise equipment from storage). For example, the user may exercise while sitting on the sofa, watching TV and/or focusing on some other activity (e.g., multitasking).

Figure 5A:
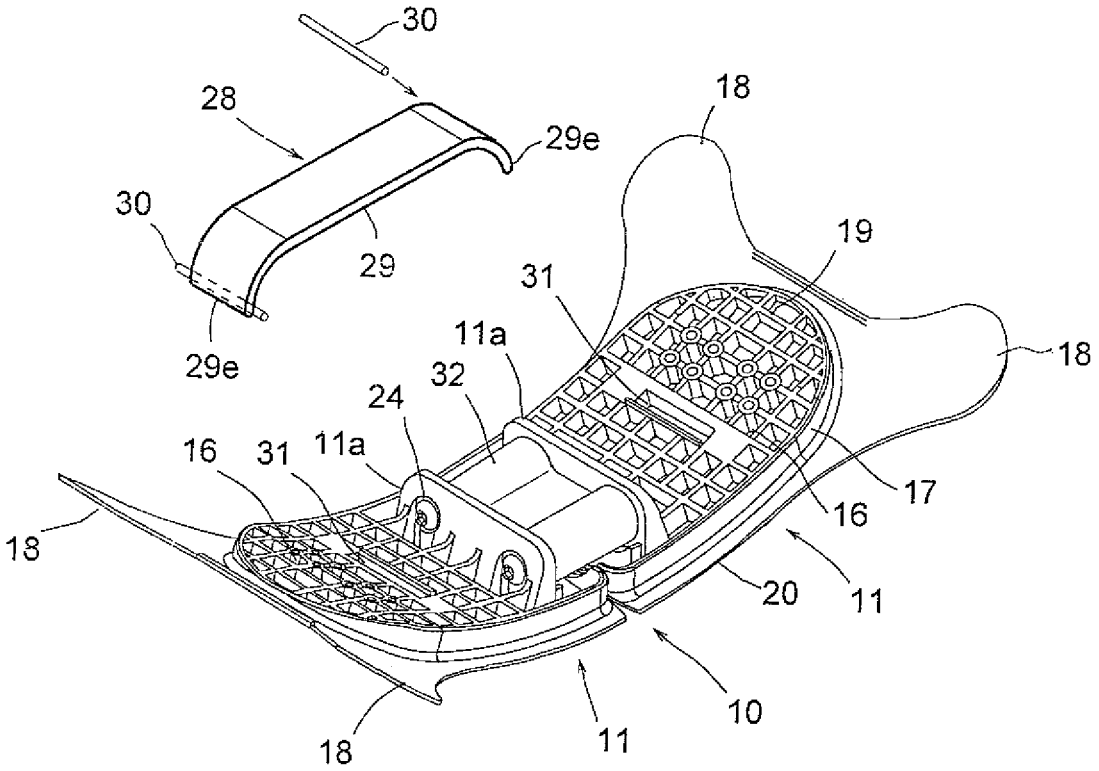
FIG. 5A and FIG. 5B are views illustrating another embodiment of the exercise cushion according to the present invention.
Figure 5B:
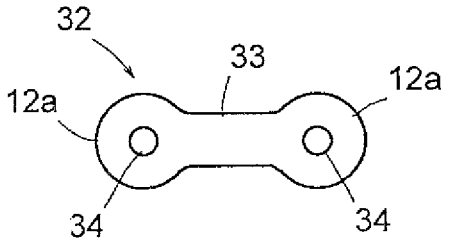

FIG. 5A and FIG. 5B show other embodiments according to the present invention. The above mentioned embodiment shown in FIGS. 1 to 4C has shown an example in which the elastic members 12, 12 are arranged in parallel between the elastic member supportive pieces 11*a*, 11*a*. In some embodiments, an integrally configured elastic member 32 may be implemented between the elastic member supportive pieces 11*a*, 11*a*. The configuration of the core main body 10 may be similar to the embodiments shown in FIGS. 1 and 2.

As shown in FIG. 5B, the elastic member 32 may be configured such that the cylindrical elastic members 12*a*, 12*a* are connected (linked) integrally with a coupling piece 33. The elastic member 32 may be mounted such that the cylindrical elastic members 12*a*, 12*a* may fit into the supportive grooves 26, 26 shown in FIG. 2. The coupling piece 33 may join the upper surface of the joint face portion 21 between the supportive grooves 26, 26. The coupling piece 33 may join the upper surface of the rib 19 between the joint face portion 21 and the elastic member supportive piece 11*a*. The fastener 24 may be screwed (threaded) into a screw hole 34 of the elastic members 12*a*, 12*a* through the elongated hole 25 of the elastic member supportive piece 11*a*. The fastener 24 may provide support for the elastic member 32 between the elastic member supportive pieces 11*a*, 11*a*.

According to the embodiment shown in FIGS. 1 to 4C, the core boards 11, 11 may be connected with the protruding portion 22 and the engaging groove 23 of the joint face portion 21. A coupling force of the both core boards 11, 11 may be an elastic force of the elastic members 12, 12, and simultaneously may be an (opposing) clamping (or compression) force (e.g., approximately 20 kg) used for the exercise of the inner thigh muscles, as shown in FIG. 4B. As the elastic member 12 has a high degree of rubber hardness, the coupling force of the core boards 11, 11 may function well without any difficulty.

It should be noted, however, that the clamping (compression) force may vary depending on a gender, age and/or other factors of the user. When the exercise is performed with a weak clamping (compression) force, then the degree of the rubber hardness may need to be lower, the outer diameter of the cylindrical elastic members 12*a*, 12*a* may need to be smaller and/or the wall thickness thereof may need to be thinner so as to reduce the elastic force. As the coupling force of the core boards 11, 11 is reduced, the engagement between the protruding portion 22 and the engaging groove 23 of the joint face portion 21 may be more likely to become disengaged. When the exercise is performed by a person with a lower physical strength (e.g., not only in the case of the exercise of the inner thigh muscles, but also in the case of a pectoral exercise in which the convex portion of the exercise cushion EC is brought up to the breast of the user and the exercise cushion EC is clamped by both hands to be bent and then restored repeatedly), a smaller elastic force of the elastic member 12 may be preferable.

The elastic member 32 according to the present embodiment is configured such that the cylindrical elastic members 12*a*, 12*a* may be integrally coupled with the coupling piece 33. Thus, even when the elastic force of the elastic member 32 is reduced, the elastic member 32 may still prevent the engagement between the protruding portion 22 and the engaging groove 23 from slipping off. As a result, the elastic member 32 may allow for assigning an adequate elastic force depending on a strength of a user who is to perform the exercises (e.g., whether an exercise of muscles of the inner thigh, the pectoral region and/or other exercises).

The invention claimed is:

1. An exercise cushion, comprising:

a core main body in which a pair of core boards each having an arc shape are connected to each other in a bendable manner;

an elastic member configured to couple to each core board and resist against a force generated when the core boards are bent;

a pair of cushion bags for housing the core boards;

an inner cushion configured to be inserted into the cushion bags with the core boards; and a cushion cover for covering the cushion bags after the core boards and the inner cushion are inserted into the cushion bags.

2. The exercise cushion according to claim 1, wherein each core boards comprises:

a center core portion having a halved elliptical shape and comprising a plurality of ribs in a parallel cross shape; and a base plate for covering a surface of the center core portion and having flaps extending outwards obliquely from both sides of a circumferential portion of the center core portion.

3. The exercise cushion according to claim 2, wherein (a) the center core portion comprises a joint face portion configured to implement (i) a protruding portion for engaging the joint face portion of the other center core portion and (ii) an engaging groove for connecting with the protruding portion and (b) the protruding portion and the engaging groove serve as a fulcrum when the core boards are bent.

4. The exercise cushion according to claim 3, wherein the joint face portion comprises a supportive groove in an arc shape for guiding the elastic member.

5. The exercise cushion according to claim 2, wherein a pair of elastic members are arranged in parallel between elastic member supportive pieces implemented in the center core portion of the core boards.

6. The exercise cushion according to claim 2, wherein the elastic member is configured such that cylindrical elastic members are integrally coupled with a coupling piece, and the elastic member is arranged between elastic member supportive pieces implemented in the center core portion of each core board.

7. The exercise cushion according to claim 1, wherein (i) the core boards are connected to each other with an opening preventive equipment and (ii) the opening preventive equipment is implemented as a woven belt so as to prevent the core boards from excessively opening.

8. The exercise cushion according to claim 7, wherein (i) the woven belt has a closed loop shape, (ii) the woven belt has loop portions on both sides of the woven belt, (iii) fixing rods are configured to be inserted into the respective loop portions of the woven belt, (iv) a belt insertion hole is formed in each core board for mounting the loop portions of the woven belt to a surface of the core boards and (v) the fixing rods are configured to be inserted into the belt insertion holes to couple the woven belt to the core boards.

9. The exercise cushion according to claim 7, wherein the opening preventive equipment is detachable.

* * * * *